US009863440B2

(12) United States Patent
Pol et al.

(10) Patent No.: US 9,863,440 B2
(45) Date of Patent: Jan. 9, 2018

(54) SUBMERSIBLE PUMP

(71) Applicant: DRAGFLOW S.R.L., Verona (IT)

(72) Inventors: Stefano Pol, Verona (IT); Mariano Gardoni, Verona (IT); Mario Sauro, San Martino Buon Albergo (IT)

(73) Assignee: DRAGFLOW S.R.L., Verona (IT)

( * ) Notice: Subject to any disclaimer, the term of this patent is extended or adjusted under 35 U.S.C. 154(b) by 280 days.

(21) Appl. No.: 14/749,679

(22) Filed: Jun. 25, 2015

(65) Prior Publication Data

US 2015/0377254 A1 Dec. 31, 2015

(30) Foreign Application Priority Data

Jun. 26, 2014 (IT) ..... PD2014A0166

(51) Int. Cl.

| | |
|---|---|
| ***F04D 29/70*** | (2006.01) |
| ***F04D 1/00*** | (2006.01) |
| ***F04D 29/42*** | (2006.01) |
| ***E02F 3/92*** | (2006.01) |
| ***F04D 7/04*** | (2006.01) |

(Continued)

(52) U.S. Cl.

CPC ..... *F04D 29/708* (2013.01); *E02F 3/9231* (2013.01); *E02F 3/9293* (2013.01); *F04D 1/00* (2013.01); *F04D 7/045* (2013.01); *F04D 13/08* (2013.01); *F04D 29/2288* (2013.01); *F04D 29/426* (2013.01)

(58) Field of Classification Search

CPC ..... F04D 29/708; F04D 1/00; F04D 7/045; F04D 13/08; F04D 29/2288; F04D 29/426; F04D 7/04; F04D 29/24; F04D 29/4273; F04D 29/4293; F04D 29/445; F04D 29/447; F04D 29/448; F04D 29/70; F04D 13/06; F04D 13/066; F04D 13/086; F04D 13/10; F04D 25/06; F04D 25/0606; F04D 25/0686; F04D 29/2261; E02F 3/9231; E02F 3/9293

USPC ..... 417/423.3

See application file for complete search history.

(56) References Cited

U.S. PATENT DOCUMENTS

| | | | | |
|---|---|---|---|---|
| 4,403,428 A | | 9/1983 | Chapman, Jr. et al. | |
| 4,456,424 A | * | 6/1984 | Araoka | E02F 3/90 366/263 |

(Continued)

FOREIGN PATENT DOCUMENTS

| | | |
|---|---|---|
| EP | 0209635 | 1/1987 |
| EP | 1270826 | 1/2003 |

(Continued)

*Primary Examiner* — Dwayne J White
*Assistant Examiner* — Peter T Hrubiec
(74) *Attorney, Agent, or Firm* — Mark M. Friedman

(57) ABSTRACT

Submersible pump which comprises: a first motor provided with a first outlet shaft; a pumping body in which an impeller is housed that is fixed to the first outlet shaft of the first motor and drivable by the latter in order to pump a process fluid from a suction mouth to a delivery mouth of the pumping body itself; a support casing fixed to the pumping body and provided, at a lower end thereof, with an inlet opening through which a flow of the process fluid is susceptible to enter into the support casing itself; a dispersion head arranged at the lower end of the support casing and drivable in order to remove detrital material, which is conveyed by the flow of the process fluid into the inlet opening of the support casing.

15 Claims, 5 Drawing Sheets

(51) Int. Cl.
*F04D 13/08* (2006.01)
*F04D 29/22* (2006.01)

(56) References Cited

U.S. PATENT DOCUMENTS

| | | | | |
|---|---|---|---|---|
| 5,238,363 | A | 8/1993 | Thielke et al. | |
| 2003/0000113 | A1* | 1/2003 | Araoka ..... | E02F 3/9212<br>37/317 |

FOREIGN PATENT DOCUMENTS

| | | |
|---|---|---|
| EP | 1270952 | 1/2003 |
| GB | 2070687 | 9/1981 |
| GB | 2126627 | 3/1984 |

* cited by examiner

SUBMERSIBLE PUMP

FIELD OF APPLICATION

The present invention regards a submersible pump according to the preamble of the independent claim.

The present submersible pump is inserted in the field of production of fluid-dynamic pumps intended to be used for treating process fluids comprising liquid mixtures having in particular a high content of abrasive solids in suspension.

Advantageously, the present pump is intended to be used in the dredging and excavation works in seabed water of ports, rivers, artificial channels, quarries, dams, wells, tanks, basins, etc., or in the mining field in order to pump mixtures containing materials with a high specific weight, or in the industrial field for treating mixtures, such as waste water, muds, bentonite mixtures, sediments from steelworks, etc.

STATE OF THE ART

The use of submersible pumps for executing the dredging of seabeds (for example of ports, rivers, channels, wells, water basins, etc.) is widespread, in order to remove from the seabeds themselves sediments containing materials such as sand, gravel, stones, detritus, etc.

In particular, such submersible pumps allow excavating the seabeds by suctioning a process fluid constituted by a liquid component, such as water, in which a solid component is mixed that is constituted by sediments of the seabed to be dredged.

For example, submersible pumps are known comprising a tubular support body extending between an upper end, connected to the dredger, and a lower end provided with an inlet opening for the process fluid.

Inside the support body, a motor is housed which is provided with an outlet shaft thereof coaxial with the support body itself, and a pumping chamber placed below the motor, containing an impeller at its interior that is fixed to the outlet shaft of the motor itself and drivable to rotate in order to pump the process fluid.

In particular, the pumping chamber is provided with a suction mouth, through which the process fluid is suctioned from the seabeds to be dredged, and with a delivery mouth, through which the process fluid is expelled from the pumping chamber in order to be conveyed to the surface through an outlet duct connected to the delivery mouth itself.

The suction mouth of the pumping chamber is connected to the inlet opening of the support body by means of a suction tube, which has a limited diameter in a manner such to increase the speed of the process fluid that flows within, in order to increase the head of the pump.

The submersible pump further comprises a dispersion head fixed to the lower end of the support body in order to remove the sediments of the seabed.

More in detail, the dispersion head comprises an auxiliary motor fixed to the support body and provided with a drive shaft carrying multiple toothed blades fixed thereon that can be driven to rotate in order to penetrate into the sediments, removing detritus from the seabed.

The driving of the impeller of the pump generates, at the inlet opening of the support body, a reduced pressure in the process fluid that sucks the detritus towards the suction tube in order to convey it into the pumping chamber.

The inlet opening of the support body is closed by a filter grating adapted to block the passage of detritus of size such to obstruct the aforesaid suction tube, allowing smaller detritus such as sand and gravel to pass through.

A first drawback of the above-described pump of known type consists of the fact that it is adapted to operate only on seabeds constituted by sand or gravel, but it is not capable of efficiently operating on seabeds also comprising detritus of relatively large size (e.g. several centimeters) due to the limited diameter of the suction tube of the pumping chamber and of the filter grating that blocks the detritus larger than sand or gravel.

A further drawback is due to the fact that the detritus that is blocked by the filter grating is accumulated thereon, causing the obstruction thereof.

A further drawback of the above-described pump of known type is due to the fact that the suction of the detritus is only caused by the pressure generated in the process fluid, which is not capable bringing up the heaviest detritus. In particular, the detritus tends to be sedimented inside the suction tube, causing the obstruction thereof.

A further example of submersible pump of known type is described in the U.S. Pat. No. 4,403,428. More in detail, such pump comprises a support body provided with a lateral wall with tubular form, closed at its lower end by a bottom plate, and a suction tube which extends between an upper opening thereof, connected to a pumping chamber, and a lower opening thereof obtained at one side of the bottom plate of the support body.

The pump further comprises a dispersion head fixed to the lower end of the support body and connected to a rotation shaft, which is arranged tilted with respect to the axis of the support body and is extended through corresponding openings made in the bottom plate and in the lateral wall of the support body. Such rotation shaft is driven by a motor arranged outside the support body and fixed to the lateral wall thereof.

The latter submersible pump of known type described in the U.S. Pat. No. 4,403,428 does not at all resolve the problem of detritus sedimentation in the suction tube.

The patent EP 0209635 describes a further submersible pump of known type which comprises a pumping body housing an impeller at its interior that is drivable in order to suction the process fluid from an inlet mouth to an outlet mouth of the pumping body itself. More in detail, the impeller is coaxially fixed to a rotation shaft passing within the pumping chamber and projecting below the latter with its lower end, to which an auger is fixed that is drivable by the rotation shaft in order to agitate the sand and gravel of the seabed.

The main drawback of the submersible pump of known type described in the patent EP 0209635 is due to the fact that it is adapted for executing the dredging of seabeds constituted by sand or gravel, not being able to operate in rocky seabeds or those formed by large-size detritus.

PRESENTATION OF THE INVENTION

In this situation, the essential object of the present invention is to overcome the drawbacks manifested by the solutions of known type, by providing a submersible pump which is entirely efficient in operation, and in particular which is capable of carrying out dredging operations on seabeds comprising detritus of relatively large size. A further object of the present invention is to provide a submersible pump that is entirely reliable in operation, which in particular does not require frequent interruptions of the dredging operations.

A further object of the present invention is to provide a submersible pump that is structurally simple and inexpensive to achieve.

A further object of the present invention is to provide a submersible pump whose maintenance is easy and inexpensive.

BRIEF DESCRIPTION OF THE DRAWINGS

The technical characteristics of the invention, according to the aforesaid objects, can be clearly found in the contents of the below-reported claims and the advantages thereof will be more evident from the following detailed description, made with reference to the enclosed drawings, which represent a merely exemplifying and non-limiting embodiment of the invention, in which:

DETAILED DESCRIPTION OF A PREFERRED EMBODIMENT

Figure 1:
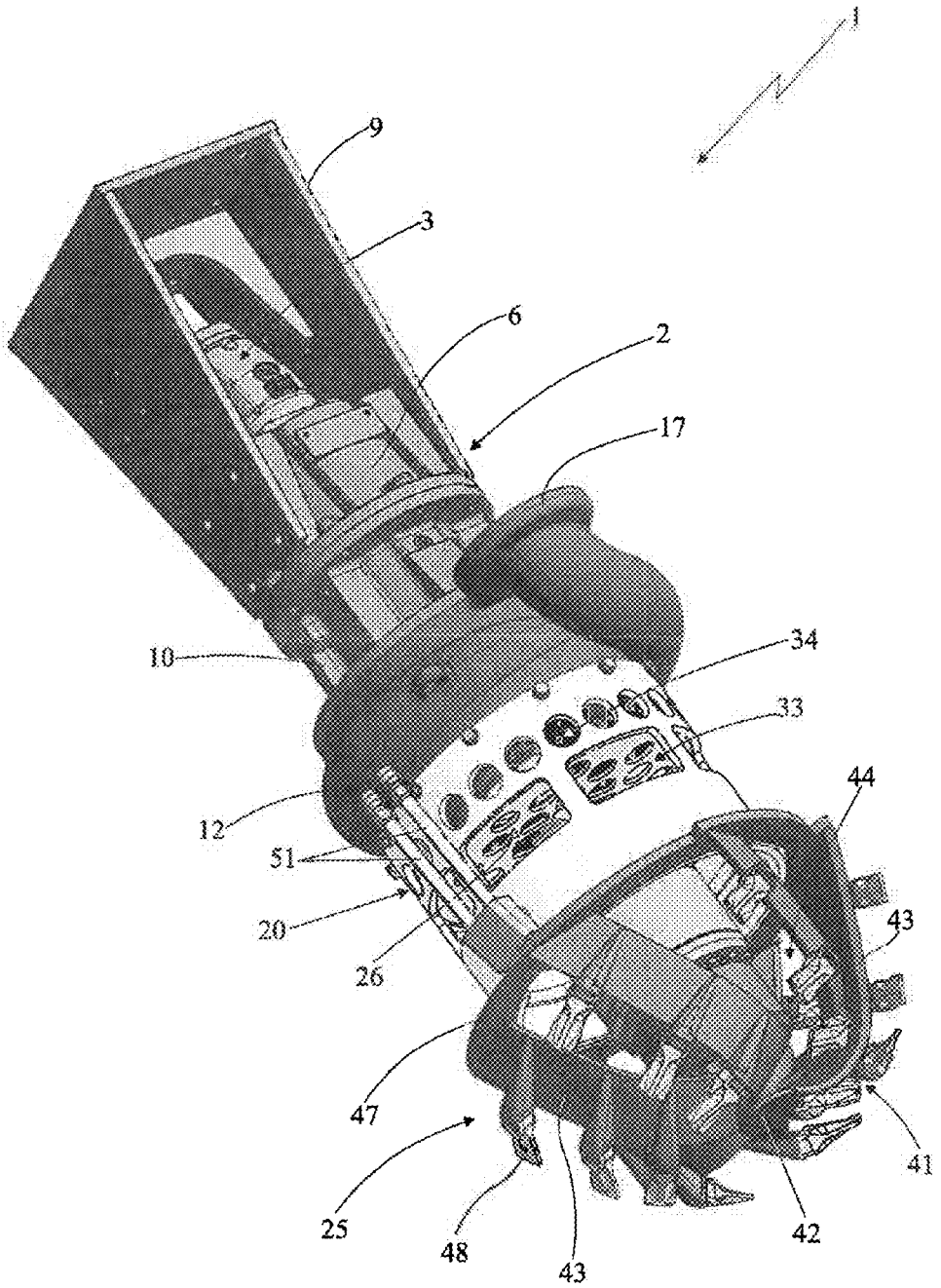
FIG. 1 shows a perspective view of the submersible pump, subject of the present invention.
Figure 2:
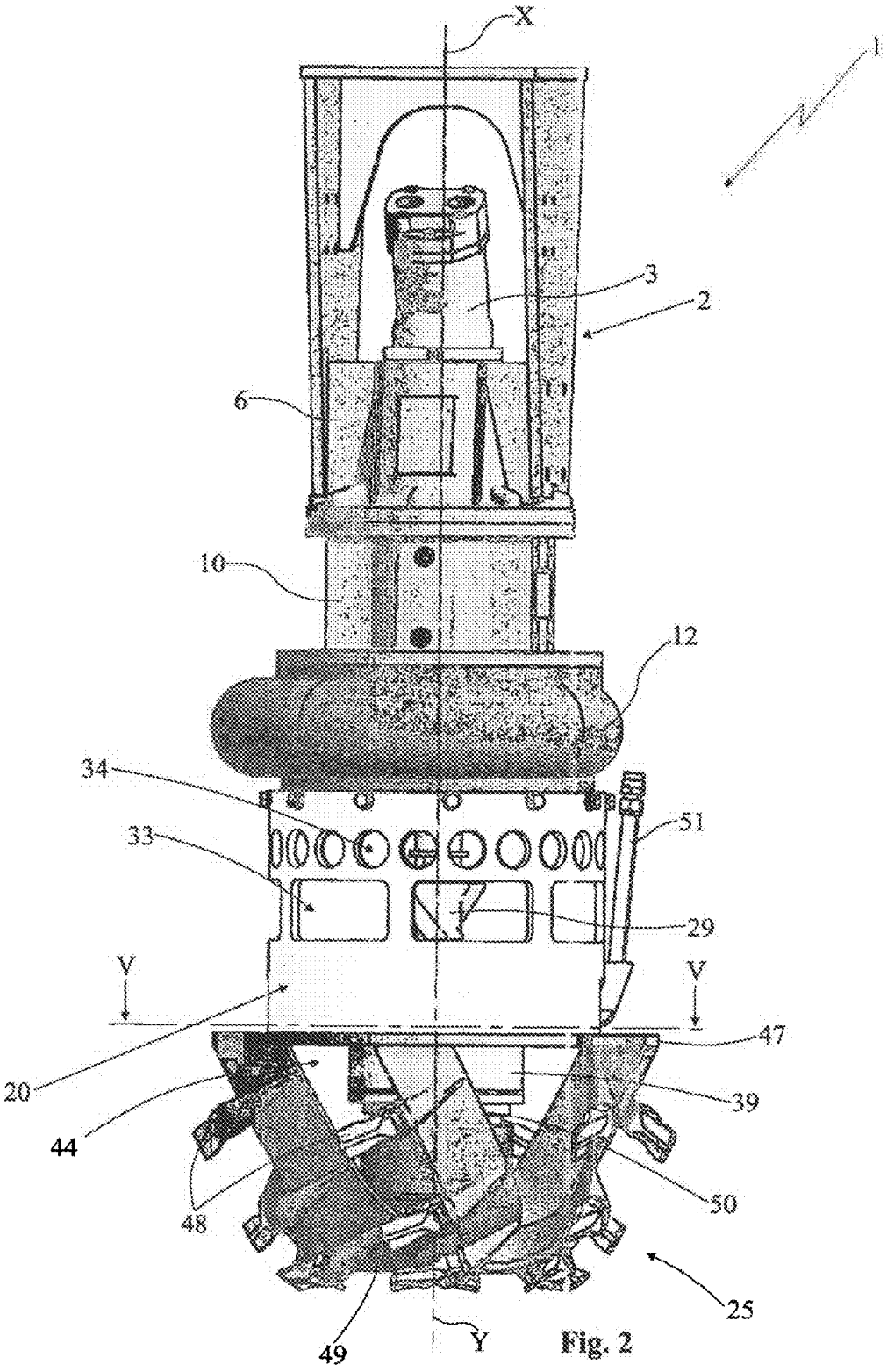
FIG. 2 shows a side view of the submersible pump illustrated in FIG. 1.
Figure 3:
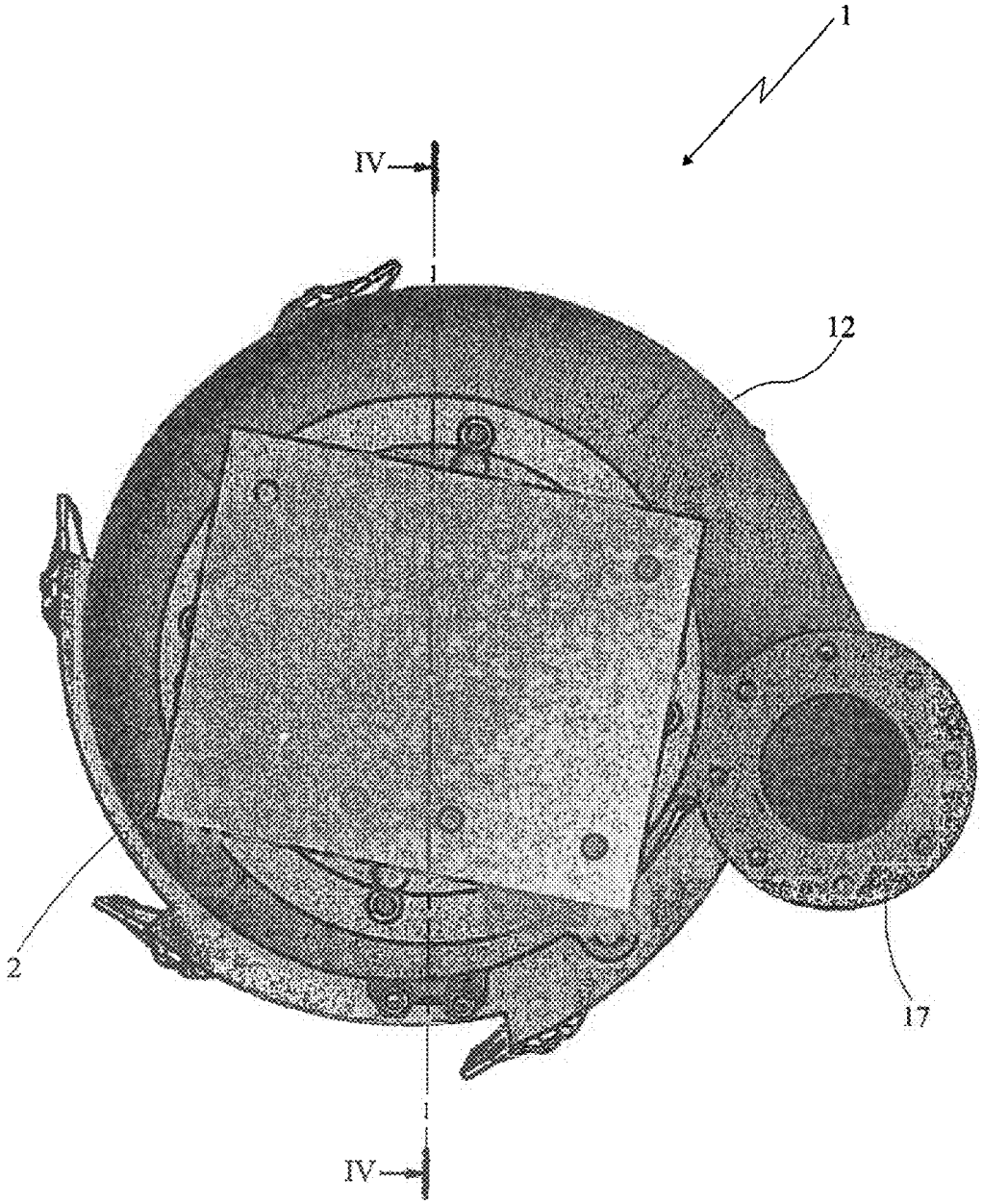
FIG. 3 shows a top plan view of the submersible pump illustrated in FIG. 1.

With reference to the enclosed drawings, a submersible pump, subject of the present invention was indicated overall with the reference number 1.

Advantageously, the present submersible pump 1 is intended to be employed for executing dredging and excavation works in seabed water.

In particular, the submersible pump 1 is intended to be mounted on a dredger provided, for example, with an articulated arm which carries the submersible pump 1 mounted thereon and is drivable to be lowered for moving the latter to the seabed to be dredged.

In accordance with the embodiment illustrated in the enclosed figures, the submersible present pump 1 comprises a support structure 2, intended to be fixed to the articulated arm of the dredger, and a first motor 3, preferably hydraulic, which is mounted on the support structure 2 itself and is provided with a first outlet shaft 4 being extended along an axis X thereof which, in normal operating conditions of the submersible pump 1, is arranged substantially vertical.

Advantageously, the support structure 2 is provided with a passage opening 5 in which the first outlet shaft 4 is inserted in a through manner, the latter rotatably constrained to the support structure 2 itself by means of multiple thrust bearings (not illustrated in the enclosed figures).

Preferably, the present submersible pump 1 comprises multiple sealing elements (not illustrated) comprising for example a plurality of oil seals, arranged in the passage opening 5 of the support structure 2, mounted around the first outlet shaft 4 of the first motor 3 and adapted to prevent infiltrations of a process fluid treated by the submersible pump 1.

With reference to the particular embodiment illustrated in the enclosed figures, the support structure 2 of the submersible pump 1 comprises a metal body 6 provided with an upper base 7 on which the first motor 3 is fixed, and with a lower base 8 directed in the direction opposite the upper base 7. The metal body 6 is preferably provided with a connection bracket 9 intended to be fixed to the articulated arm of the dredger.

The support structure 2 also comprises a containment tank 10, which is fixed to the lower base 8 of the metal body 6 and is arranged coaxially around the first outlet shaft 4 of the first motor 3.

The containment tank 10 defines an oil chamber 11 at its interior adapted to contain a lubricant fluid (e.g. oil) for the aforesaid sealing elements arranged around the first outlet shaft 4 of the first motor 3.

According to the invention, the submersible pump 1 comprises a pumping body 12, internally hollow, preferably helix-shaped, which is fixed to the support structure 2, in particular below the containment tank 10.

The pumping body 12 is provided with a first through opening 14, inside of which the first outlet shaft 4 of the first motor 3 is inserted.

The submersible pump 1 also comprises an impeller 15, preferably of centrifugal type, arranged inside the pumping body 12 and fixed to the first outlet shaft 4 of the first motor 3 preferably by means of fitting.

The pumping body 12 is provided on the lower part with a suction mouth 16, through which the process fluid enters inside the pumping body 12, in which it is energized by the rotating impeller 15, and with a delivery mouth 17, through which the process fluid is expelled under pressure by the pumping body 12 in order to be conveyed towards the dredger preferably through an outlet duct (not illustrated) connected to the delivery mouth 17 itself.

Advantageously, the pumping body 12 of the submersible pump 1 is provided on the upper part with a first closure wall 18, fixed to the containment tank 10, in which the aforesaid first through opening 14 is obtained in which the first outlet shaft 4 of the first motor 3 is inserted.

The pumping body 12 is provided on the lower part with a second closure wall 19 in which the suction mouth 16 is obtained.

Advantageously, the suction mouth 16 of the pumping body 12 is arranged aligned with the first through opening 14 along the axis X and is crossed in a through manner by the first outlet shaft 4 of the first motor 3.

According to the invention, the submersible pump 1 comprises a support casing 20 fixed to the pumping body 12, provided with a lateral wall 21 being extended around the axis X of the first outlet shaft 4.

The support casing 20 is extended along the axis X between an upper end 22 thereof, connected to the suction mouth 16 of the pumping body 12, and a lower end 23 thereof provided with an inlet opening 24, through which the flow of the process fluid containing detrital material is susceptible to enter, as described in detail hereinbelow.

The submersible pump 1 further comprises a dispersion head 25, arranged at the lower end 23 of the support casing 20, aligned with the axis X and drivable in order to remove the detrital material from the seabed, conveying such detrital material towards the inlet opening 24 of the support casing 20 itself.

In operation, the first motor 3 is driven in order to rotate its first outlet shaft 4 which in turn rotates the impeller 15 in order to pump the process fluid from the suction mouth 16 towards the delivery mouth 17 of the pumping body 12.

In particular, the impeller 15, driven in rotation, causes a first flow of the process fluid which enters into the support casing 20 through the inlet opening 24 of the latter, conveying the detrital material removed by the dispersion head 25 towards the pumping body 12.

In normal operating conditions of the submersible pump 1, the process fluid comprises a liquid component (constituted by water, for example), in which solid bodies of the detrital material removed from the seabed (for example constituted by rocks, stones, gravel, sand, etc.) are mixed.

Figure 4:
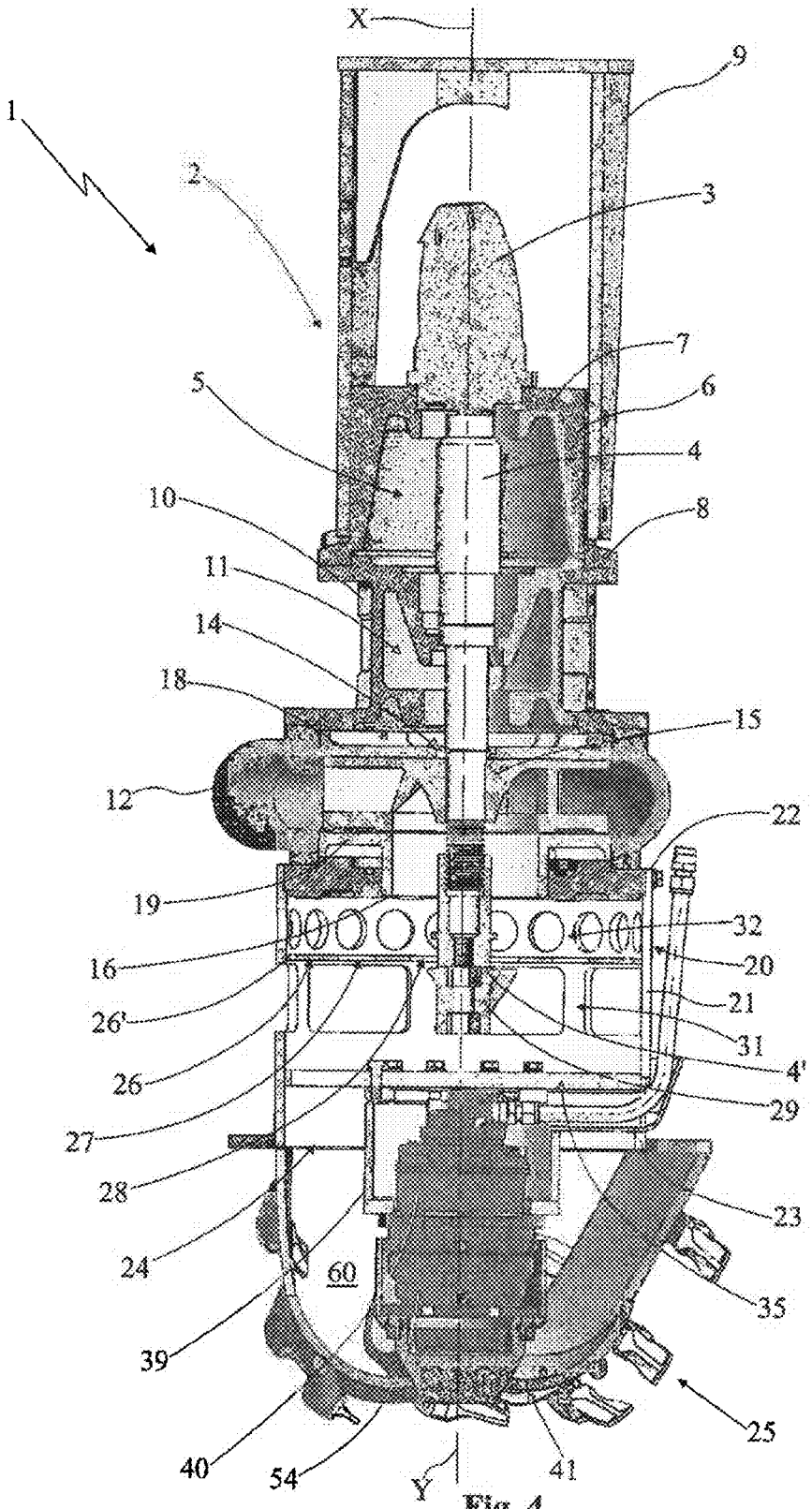
FIG. 4 shows a sectional view of the submersible pump illustrated in FIG. 3 along the line IV-IV of the same FIG. 3.

With reference to the embodiment illustrated in FIG. 4, the first outlet shaft 4 of the first motor 3 is extended, along its axis X, through the passage opening 5 of the support structure 2, through the first through opening 14 and the suction mouth 16 of the pumping body 12 until it enters, with a lower terminal part 4' thereof, inside the support casing 20.

In accordance with the idea underlying the present invention, the submersible pump 1 comprises a first filtering element 26 arranged inside the support casing 20 and adapted to block bodies of the detrital material conveyed by the first flow of process fluid and having size such to be able to obstruct the pumping body 12 and the impeller 15.

More in detail, the first filtering element 26 is provided with multiple first filtering holes 27 through which first bodies of the detrital material are susceptible to pass, such first bodies being smaller than such first filtering holes 27. The first filtering element 26 is adapted to intercept second bodies of the detrital material that are larger than the first filtering holes 27, blocking such second bodies in order to prevent them from reaching the pumping body 12 and obstructing it.

For example, the first filtering holes 27 of the first filtering element 26 have substantially circular shape with approximately 60 mm diameter.

The first filtering element 26 is provided with a second through opening 28, aligned with the axis X, and through which the first outlet shaft 4 of the first motor 3 is inserted. According to the invention, the submersible pump 1 further comprises an agitator element 29 arranged inside the support casing 20 and positioned between the dispersion head 25 and the first filtering element 26. Such agitator element 29 is fixed to the first outlet shaft 4 and is drivable by the latter to rotate around the axis X in order to bring the detrital material in suspension into the process fluid (thus facilitating the suction of the first bodies of the detrital material towards the pumping body 12) and in order to remove the second bodies of the detrital material from the first filtering element 26 (preventing the obstruction of the latter).

Advantageously, the agitator element 29 comprises an auger arranged coaxial with the axis X and preferably fixed to the lower end part 4' of the first outlet shaft 4 of the first motor 3, in particular by means of a retention screw inserted in a central hole of the agitator element 29 and screwed in a threaded hole of the first outlet shaft 4.

Advantageously, the auger of the agitator element 29 is arranged in order to impart, in the process fluid, a helical motion with axial direction opposite the direction of the first flow of the process fluid suctioned towards the pumping body 12, in order to facilitate the removal of the solid second bodies of the detrital material from the first filtering element 26, ensuring an improved cleaning thereof.

In accordance with the embodiment particular illustrated in the enclosed figures, the lateral wall 21 of the support casing 20 has substantially tubular form, preferably cylindrical, and at its interior delimits a space in which the first filtering element 26 and the agitator element 29 are arranged.

Advantageously, the upper end 22 of the support casing 20 is positioned concentrically around the suction mouth 16 of the pumping body 12 and is fixed, by means of preferably bolting, to the second closure wall 19 of the pumping body 12 itself.

Advantageously, the first filtering element 26 of the submersible pump 1 comprises a perforated wall 26' arranged transverse to the axis X and positioned between the upper end 22 and lower end 23 of the support casing 20 to partially close the internal space of the casing 20 itself. In particular, the perforated wall 26' is provided with a front face directed towards the lower end 23 of the support casing 20, on which the solid second bodies of the detrital material are susceptible to be stopped, such bodies larger than the first filtering holes 27 of the first filtering element 26.

Advantageously, the perforated wall 26' of the first filtering element 26 divides the internal space of the support casing 20 into a first chamber 31 placed upstream of the perforated wall 26' (along the advancing direction of the first flow of the process fluid) and a second chamber 32 placed downstream of the perforated wall 26' and communicating with the suction mouth 16 of the pumping body 12.

In particular, the first chamber 31, in which the agitator element 29 is arranged, is extended between the perforated wall 26' and the lower end 23 of the support casing 20, and the second chamber 32 is extended between the perforated wall 26' and the upper end 22 of the support casing 20 itself.

Advantageously, the lateral wall 21 of the support casing 20 is provided with first lateral perforations 33 arranged at the first chamber 31, and through which the agitator element 29 is susceptible to expel, from the first chamber 31 itself, the second bodies of detrital material intercepted by the first filtering element 26.

Preferably, the first lateral perforations 33 are positioned between the first filtering element 26 and the lower end 23 of the support casing 20 and are arranged in particular aligned as a ring around the axis X of the first outlet shaft 4 of the first motor 3. Advantageously, the first lateral perforations 33 have greater size than the first filtering holes 27 of the first filtering element 26 so as to be able to allow the second bodies of the detrital material (intercepted by the first filtering element 26) to pass through such first lateral perforations 33 in order to exit from the first chamber 31 of the support casing 20.

Conveniently, the lateral wall 21 of the support casing 20 is provided with second lateral perforations 34 arranged at the second chamber 32, and through which a second flow of the process fluid is susceptible to enter into the second chamber 32 itself, enclosing the detrital material and further mixing it with the process fluid, in a manner such to form a substantially uniform suspension of the detrital material in the process fluid, in order to facilitate the suction of the detrital material itself in the pumping body 12.

Preferably, the second lateral perforations 34 of the support casing 20 have size smaller or substantially equal to that of the first filtering holes 27 of the first filtering element 26, in order to prevent the entrance into the second chamber 32 of solid bodies of the detrital material that can obstruct the pumping body 12.

Advantageously, the support casing 20 comprises a second filtering element 35 placed between the agitator element 29 and the dispersion head 25, provided with second filtering holes 36 of larger size than the first filtering holes 27 of the first filtering element 26 and adapted to intercept bodies of the detrital material with size such to obstruct the internal space of the support casing 20 and block the rotation of the agitator element 29.

Figure 5:
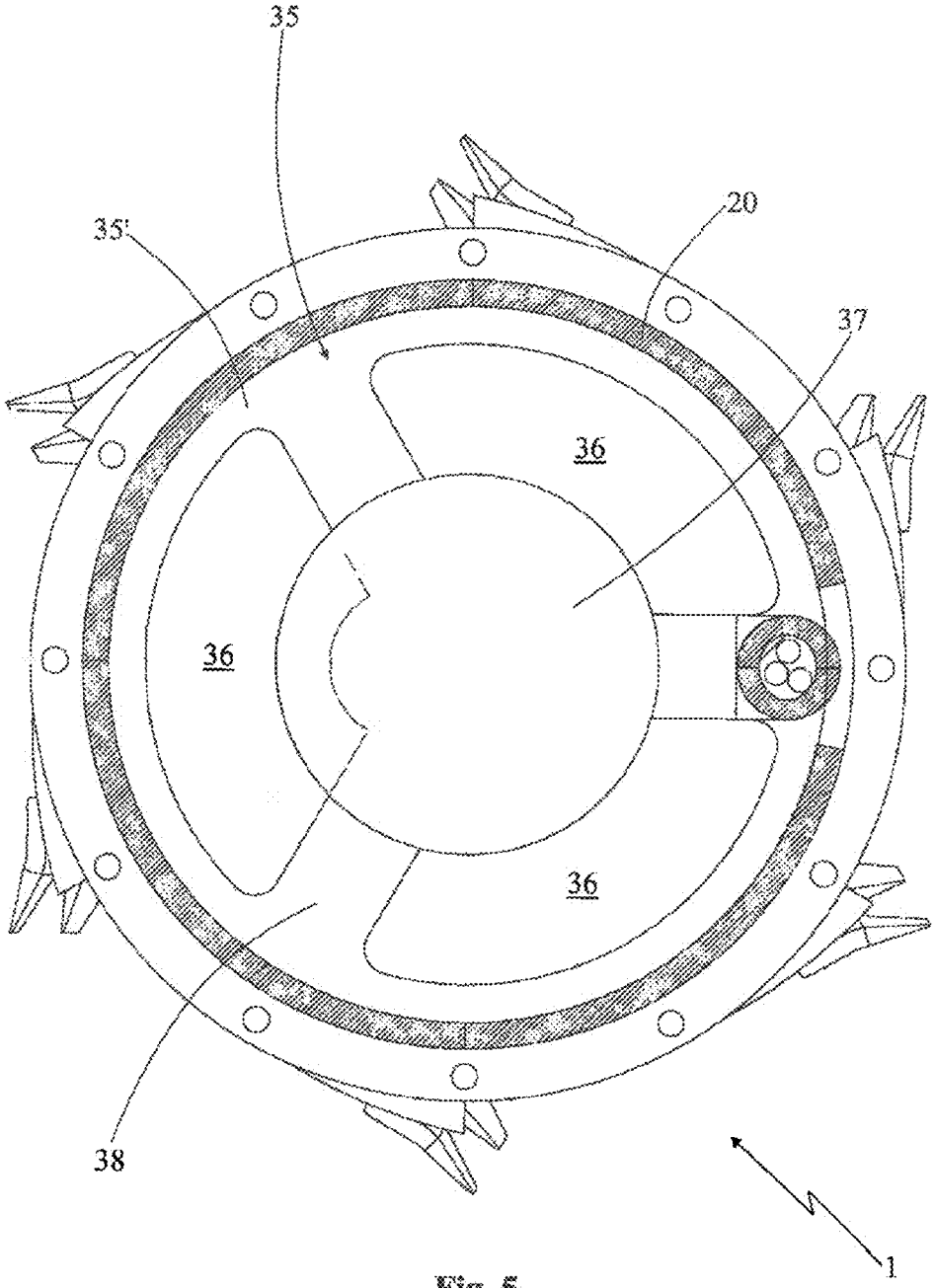
FIG. 5 shows a further sectional view of the submersible pump illustrated in FIG. 2 along the line V-V of the same FIG. 2.

In accordance with the embodiment illustrated in FIG. 5, the second filtering element 35 comprises a perforated plate 35' fixed to the lateral wall 21 of the support casing 20, provided with a central portion 37 (aligned with the axis X)

from which multiple spokes 38 (e.g. three) are extended in radial direction, which together delimit the aforesaid second filtering holes 36.

Advantageously, the dispersion head 25 of the submersible pump 1 comprises a support body 39 fixed to the support casing 20 and an excavator auger 41 which is rotatably constrained to the support body 39 in a manner such to rotate around a rotation axis Y thereof preferably aligned with the axis X of the first outlet shaft 4 of the first motor 3. Advantageously, the dispersion head 25 also comprises a second motor 40, which is mounted on the support body 39 and is mechanically connected to the excavator auger 41 in order to bring the latter in rotation around the rotation axis Y, in order to remove the detrital material from the seabed to be dredged.

Preferably, the second motor 40 of the dispersion head 25 is positioned aligned with the axis X, and is arranged between the agitator element 29 and the excavator auger 41, and in particular between the second filtering element 35 and the excavator auger 41.

In accordance with the embodiment illustrated in the enclosed figures, the excavator auger 41 of the dispersion head 25 is provided with multiple blades 43, which are arranged around the rotation axis Y of the auger 41 itself, and together delimit a space 60 inside of which the second motor 40 of the dispersion head 25 itself is at least partially housed.

More in detail, advantageously, the excavator auger 41 is provided with a central hub 42 aligned with the rotation axis Y and carrying the blades 43 fixed thereon, which are extended around the rotation axis Y itself and are separated from each other by a corresponding lateral slit 44.

The blades 43 of the excavator auger 41 are bent backwards towards the support casing 20, defining a substantially cup-like shape of the excavator auger 41 itself, in a manner such to delimit, inside the latter, the aforesaid space 60 in which the second motor 40 is housed.

In particular, the blades 43 of the excavator auger 41 are each extended between a front end fixed to the central hub 42 and a rear end fixed to a base ring 47 arranged around the lower end 23 of the support casing 20.

Advantageously, each blade 43 is provided with multiple projecting teeth 48 which, during the rotation of the excavator auger 41, are adapted to penetrate into the seabed in order to remove and break up the material that composes the seabed itself.

Advantageously, each blade 43 of the excavator auger 41 comprises a shaped plate, which is provided with two longitudinal edges 49, 50, including an external longitudinal edge 49 from which the teeth 48 projectingly extend, and an internal longitudinal edge 50.

Each blade 43 is arranged tilted with respect to the rotation axis Y, with the external longitudinal edge 49 further away from the rotation axis Y than the internal longitudinal edge 50. Such tilt of the blades 43 of the excavator auger 41, during the rotation thereof, causes a motion of the process fluid that conveys the detrital material removed by the teeth 48 towards the interior of the excavator auger 41 through the lateral slits 44 obtained between the blades 43 of the auger 41 itself.

Advantageously, the rotation axis Y of the excavator anger 41 of the dispersion head 25 is aligned, along the axis X, with the inlet opening 24 of the support casing 20 and with the suction mouth 16 of the pumping body 12. In this manner, in particular, the excavator auger 41, following its rotation, is adapted to convey the detrital material to the interior of the support casing 20, uniformly distributing the detrital material around the axis X. This determines a more uniform dispersion of the detrital material inside the support casing 20, hence facilitating the suction of the detrital material in the suction mouth 16 of the pumping body 12 in particular without forming sedimentation of the detrital material itself.

Advantageously, the support body 39 of the dispersion head 25 is fixed to the second filtering element 35 of the support casing 20.

More in detail, the support body 39 of the dispersion head 25 is fixed, preferably by means of bolting, to the central portion 37 of the perforated plate 35' of the second filtering element 35, in particular extended through the inlet opening 24 of the support casing 20.

Preferably, the support body 39 has substantially tubular form, with axis parallel to the rotation axis Y, and at least partially houses the second motor 40 of the dispersion head 25 at its interior.

The second motor 40 is preferably of hydraulic type and is supplied with a hydraulic fluid by means of supply ducts 51 passing through a first hole obtained on the support body 39 and a second hole obtained on the support casing 20.

Preferably, the second motor 40 is provided with a second outlet shaft (not illustrated) connected to the excavator auger 41 by means of a gear motor 54.

In operation, the submersible pump 1 is brought to the seabed to be dredged, for example, through the movement of the articulated arm of the dredge.

The first motor 3 and the second motor 40 are driven in order to respectively rotate the impeller 15 and the agitator element 29 (by means of the first outlet shaft 4), and the excavator auger 41 of the dispersion head 25 (by means of the second outlet shaft and preferably the gear motor 54).

In particular, the excavator auger 41 of the dispersion head 25 is driven to rotate by the first motor 3 at a speed comprised between about 20 and 30 revolutions per minute. Preferably, the impeller 15 is driven to rotate by the second motor 40 at a speed comprised between about 600 and 900 revolutions per minute.

Following the rotation of the excavator auger 41 of the dispersion head 25, the teeth 48 of the blades 43 penetrate into the seabed in order to break up and remove the detrital material, mixing it with the process fluid.

Advantageously, the rotation of the excavator auger 41, in particular following the tilt of the above-described blades 43, conveys the detrital material towards the rotation axis Y of the excavator auger 41 and towards the inlet opening 24 of the support casing 20.

The impeller 15 of the submersible pump 1, driven in rotation by the first motor 3, determines the first flow of the process fluid which enters into the support casing 20 through the inlet opening 24 of the latter, passes through the second and the first filtering element 35 and 26, enters inside the pumping body 12 through the suction mouth 16 of the latter and, after having been energized by the impeller 15, is expelled by the pumping body 12 through the delivery mouth 17.

The aforesaid first flow of the process fluid conveys the detrital material mixed therein to the interior of the support casing 20, through the inlet opening 24.

The second filtering element 35 intercepts the larger bodies of the detrital material which could obstruct the rotation of the agitator element 29. The remaining part of the detrital material, driven by the first flow of process fluid, passes through the second filtering holes 36 of the second filtering element 35, entering into the first chamber 31 of the support casing 20.

Subsequently, the first filtering element 26 intercepts the second bodies of the detrital material, with size larger than that of the first filtering holes 27 of the first filtering element 26, in order to prevent such second bodies from obstructing the pumping body 12.

The agitator element 29, which is rotated by the first outlet shaft 4 with the same speed as the impeller 15, generates turbulence inside the first chamber 31 of the support casing 20 which carries the detrital material in suspension into the process fluid, causing a substantially uniform mixture that can be easily suctioned into the pumping body 12.

In addition, the turbulence generated by the agitator element 29 removes, from the first filtering element 26, the solid second bodies of the detrital material intercepted by the first filtering element 26 itself, thus ensuring that, on the front face of the perforated wall 26' of the first filtering element 26, detritus is not accumulated which could obstruct the first filtering element 26 itself.

In particular, the agitator element 29 radially pushes the second bodies of the detrital material, accumulated on the first filtering element 26, away from the axis X, expelling such second bodies outside the first chamber 31 of the support casing 20 through the first lateral perforations 33 obtained on the lateral wall 21 of the casing 20 itself.

The first bodies of the detrital material, which pass through the first filtering holes 27 of the first filtering element 26, enter into the second chamber 32 of the support casing 20, and are enclosed by the second flow of process fluid that enters into the second chamber 32 through the second lateral perforations 34 of the support casing 20 itself.

In this manner, such second flow causes a further mixing of the detrital material in the process fluid, so as to facilitate the formation of a uniform suspension of the detrital material in the process fluid, in order to facilitate the suction of the detrital material itself in the pumping body 12.

When the process fluid, with the detrital material mixed therewith, enters into the pumping body 12, the fluid is energized by the rotating impeller 15 and is expelled together with the detrital material through the delivery mouth 17 by the pumping body 12, in order to be conveyed onto the dredger through the outlet duct connected to the delivery mouth 17 itself.

The invention thus conceived therefore attains the pre-established objects.

The invention claimed is:

1. Submersible pump (1) which comprises:

a support structure (2);

a first motor (3) fixed to said support structure (2) and provided with a first outlet shaft (4) being extended along an axis (X);

a pumping body (12) fixed to said support structure (2), provided with a first through opening (14) inside of which said first outlet shaft (4) is inserted, and provided with a suction mouth (16), through which a process fluid is susceptible to enter into said pumping body (12), and with a delivery mouth (17), through which said process fluid is susceptible to exit from said pumping body (12);

an impeller (15) arranged inside said pumping body (12), fixed to said first outlet shaft (4) and drivable by said first outlet shaft (4) to rotate around said axis (X) in order to pump said process fluid from said suction mouth (16) to said delivery mouth (17);

a support casing (20) fixed to said pumping body (12), provided with a lateral wall (21) being extended around said axis (X), and being extended along said axis (X) between an upper end (22), connected to the suction mouth (16) of said pumping body (12), and a lower end (23), provided with an inlet opening (24) through which a first flow of said process fluid is susceptible to enter into said support casing (20);

a dispersion head (25), arranged at the lower end (23) of said support casing (20), aligned with said axis (X) and intercepted by said axis (X), and drivable in order to remove detrital material, which is susceptible to be conveyed by said first flow of process fluid into the inlet opening (24) of said support casing (20);

a first filtering element (26) arranged inside said support casing (20), provided with a second through opening (28) through which said first outlet shaft (4) is inserted, and provided with first filtering holes (27), through which first bodies of said detrital material are susceptible to pass, such first bodies being smaller than said first filtering holes (27), and such first filtering element (26) being adapted to intercept second bodies of said detrital material larger than said first filtering holes (27);

an agitator element (29) arranged inside said support casing (20) between said dispersion head (25) and said first filtering element (26), fixed to said first outlet shaft (4) and drivable by the latter to rotate around said axis (X) in order to bring said detrital material in suspension in said process fluid and to remove said second bodies of said detrital material from said first filtering element (26).

2. Submersible pump (1) according to claim 1, wherein said first filtering element (26) comprises a perforated wall (26') positioned transverse to said axis (X) and arranged between said upper end (22) and said lower end (23) of said support casing (20).

3. Submersible pump (1) according to claim 2, wherein the perforated wall (26') of said first filtering element (26) defines, inside said support casing (20), a first chamber (31), extending between said perforated wall (26') and the lower end (23) of said support casing (20), and in such first chamber (31), said agitator element is arranged, and a second chamber (32) being extended between said perforated wall (26') and the upper end (22) of said support casing (20).

4. Submersible pump (1) according to claim 3, wherein the lateral wall (21) of said support casing (20) is provided with first lateral perforations (33) arranged at said first chamber (31) and through which said agitator element (29) is susceptible to expel, from said first chamber (31), said second bodies of said detrital material intercepted by said first filtering element (26).

5. Submersible pump (1) according to claim 3, wherein the lateral wall (21) of said support casing (20) is provided with second lateral perforations (34) arranged at said second chamber (32) and through which a second flow of said process fluid is susceptible to enter into said second chamber (32).

6. Submersible pump (1) according to claim 1, wherein said support casing (20) comprises a second filtering element (35) placed between said agitator element (29) and said dispersion head (25), and provided with second filtering holes (36) of larger size than the first filtering holes (27) of said first filtering element (26).

7. Submersible pump (1) according to claim 1, wherein said dispersion head (25) comprises:

a support body (39) fixed to said support casing (20);

an excavator auger (41) rotatably constrained to said support body (39) around a rotation axis (Y) thereof.

8. Submersible pump (1) according to claim 7, wherein said excavator auger (41) is positioned with the rotation axis (Y) thereof aligned with said axis (X).

9. Submersible pump (1) according to claim 7, wherein said dispersion head (25) comprises a second motor (40) mounted on said support body (39) and mechanically connected to said excavator auger (41) in order to bring the latter in rotation around said rotation axis (Y).

10. Submersible pump (1) according to claim 9, wherein said second motor (40) is positioned aligned with said axis (X) between said agitator element (29) and said excavator auger (41).

11. Submersible pump (1) according to claim 9, wherein the excavator auger (41) of said dispersion head (25) is provided with multiple blades (43) which are arranged around said rotation axis (Y) and together delimit a space (60) inside of which said second motor (40) is at least partially housed.

12. Submersible pump (1) according to claim 11, wherein the excavator auger (41) of said dispersion head (25) is provided with a central hub (42) aligned with said rotation axis (Y) and carrying said blades (43) fixed thereon, such blades extending around said rotation axis (Y) and bent towards said support casing (20), together delimiting said space inside of which said second motor (40) is at least partially housed.

13. Submersible pump (1) according to claim 7, wherein the rotation axis (Y) of said excavator auger (41) is aligned, along said axis (X), with the inlet opening (24) of said support casing (20) and with the suction mouth (16) of said pumping body (12).

14. Submersible pump (1) according to claim 7, wherein said support casing (20) comprises a second filtering element (35) placed between said agitator element (29) and said dispersion head (25), and provided with second filtering holes (36) of larger size than the first filtering holes (27) of said first filtering element (26);

the support body (39) of said dispersion head (25) being fixed to said second filtering element (35).

15. Submersible pump (1) according to claim 1, wherein said agitator element (29) comprises at least one auger arranged coaxially with said axis (X).

* * * * *